US009873971B2

(12) United States Patent
Park et al.

(10) Patent No.: US 9,873,971 B2
(45) Date of Patent: Jan. 23, 2018

(54) CONTROL METHOD OF CLOTHES TREATMENT APPARATUS

(71) Applicant: LG ELECTRONICS INC., Seoul (KR)

(72) Inventors: Hyoungsup Park, Seoul (KR); Youngjin Doh, Seoul (KR); Sunghoo Park, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 14/972,680

(22) Filed: Dec. 17, 2015

(65) Prior Publication Data

US 2016/0177490 A1 Jun. 23, 2016

(30) Foreign Application Priority Data

Dec. 19, 2014 (KR) ..... 10-2014-0184453

(51) Int. Cl.
*D06F 39/00* (2006.01)
*D06F 39/08* (2006.01)
(Continued)

(52) U.S. Cl.
CPC ..... *D06F 39/008* (2013.01); *D06F 37/26* (2013.01); *D06F 39/087* (2013.01);
(Continued)

(58) Field of Classification Search
None
See application file for complete search history.

(56) References Cited

U.S. PATENT DOCUMENTS 8,484,861 B2 * 7/2013 Park ..... D06F 58/10 219/400
2008/0155757 A1 * 7/2008 Kim ..... D06F 58/10 8/149.3
(Continued)

FOREIGN PATENT DOCUMENTS

CN 202755230 U 2/2013
EP 1616516 1/2006
(Continued)

OTHER PUBLICATIONS

International Search Report and Written Opinion in International Application No. PCT/KR2015/013982, dated Apr. 27, 2016, 8 pages.
(Continued)

*Primary Examiner* — Michael E Barr
*Assistant Examiner* — Cristi J Tate-Sims
(74) *Attorney, Agent, or Firm* — Fish & Richardson P.C.

(57) ABSTRACT

A control method of a clothes treatment apparatus including a cabinet, a steam unit that is located in the cycle chamber and that is configured to supply steam to the treatment chamber, a water supply tank, a water supply pump, and a lower rack. The control method includes sensing a water level in the water supply tank. The control method further includes, based on sensing the water level in the water supply tank, determining that the water level in the water supply tank is below a first particular water level. The control method further includes, in response to determining that the water level in the water supply tank is below the first particular water level, moving residual water stored in the receiving space to the steam unit by operating the water supply pump.

10 Claims, 12 Drawing Sheets

(51) Int. Cl.

| | |
|---|---|
| ***D06F 37/26*** | (2006.01) |
| ***D06F 58/20*** | (2006.01) |
| ***D06F 58/28*** | (2006.01) |
| *D06F 58/10* | (2006.01) |

(52) U.S. Cl.
CPC ..... *D06F 39/088* (2013.01); *D06F 58/203* (2013.01); *D06F 58/28* (2013.01); *D06F 58/10* (2013.01); *D06F 2058/2858* (2013.01)

(56) References Cited

U.S. PATENT DOCUMENTS

| | | | | |
|---|---|---|---|---|
| 2009/0126421 | A1* | 5/2009 | Kim | D06F 29/00 68/5 C |
| 2009/0133298 | A1* | 5/2009 | Kim | D06F 73/02 38/14 |
| 2009/0151193 | A1* | 6/2009 | Moon | D06F 58/20 34/621 |
| 2009/0241606 | A1* | 10/2009 | Yoo | D06F 25/00 68/5 C |
| 2011/0030147 | A1* | 2/2011 | Yoo | D06F 58/10 8/137 |
| 2011/0252837 | A1* | 10/2011 | Bae | D06F 39/008 68/5 C |
| 2014/0053615 | A1* | 2/2014 | Fukuda | D06F 39/04 68/5 C |
| 2014/0238086 | A1 | 8/2014 | Choi et al. | |

FOREIGN PATENT DOCUMENTS

| | | | |
|---|---|---|---|
| EP | 2610399 A1 * | 7/2013 | D06F 58/203 |
| KR | 10-2008-0083995 | 9/2008 | |
| KR | 10-2008-0107767 | 12/2008 | |
| KR | 10-2008-0107787 | 12/2008 | |
| KR | 10-1430477 | 8/2014 | |
| KR | 10-2014-0108454 | 9/2014 | |
| KR | 10-1467776 | 12/2014 | |
| WO | 2009/123407 | 10/2009 | |

OTHER PUBLICATIONS

Extended European Search Report issued in European Application No. 15201310.8 dated May 10, 2016, 6 pages.

* cited by examiner

CONTROL METHOD OF CLOTHES TREATMENT APPARATUS

CROSS-REFERENCE TO RELATED APPLICATION

This application claims the priority benefit of Korean Patent Application No. 10-2014-0184453, filed on Dec. 19, 2014 in the Korean Intellectual Property Office, the disclosure of which is incorporated herein by reference.

FIELD

The present disclosure relates to a control method of a clothes treatment apparatus.

BACKGROUND

Clothes treatment apparatuses are apparatuses that treat clothes, e.g. wash and dry clothes and smooth wrinkles in clothes, at home or at laundromats.

Clothes treatment apparatuses may be classified into a washer for washing clothes, a dryer for drying clothes, a washer/dryer having both a washing function and a drying function, a refresher for refreshing clothes, and a steamer for removing unnecessary wrinkles in clothes.

The refresher is an apparatus that keep clothes comfortable and fresh. The refresher functions to dry clothes, to supply fragrance to clothes, to prevent the occurrence of static electricity in clothes, or to remove wrinkles from clothes.

The steamer is an apparatus that supplies steam to clothes in order to remove wrinkles from the clothes. Unlike a general iron, the steamer removes wrinkles from the clothes without directly applying heat to the clothes.

SUMMARY

According to an innovative aspect of the subject matter described in this application, a control method of a clothes treatment apparatus including a cabinet that is partitioned into a treatment chamber that is configured to receive clothes, a cycle chamber that is configured to house machinery, and a tank installation space that is configured to house a removable tank; a steam unit that is located in the cycle chamber and that is configured to supply steam to the treatment chamber; a water supply tank that is located in the tank installation space, that is connected to the steam unit, and that is configured to supply water to the steam unit; a water supply pump that is configured to supply water in the water supply tank to the steam unit; a lower rack that is located in the tank installation space and that is configured to couple to the water supply tank; and a receiving space that is defined by the lower rack, that is configured to connect to the steam unit, that is configured to supply water to the steam unit, and that is configured to store residual water discharged based on removing the water supply tank, where the control method includes sensing a water level in the water supply tank; based on sensing the water level in the water supply tank, determining that the water level in the water supply tank is below a first particular water level; and in response to determining that the water level in the water supply tank is below the first particular water level, moving residual water stored in the receiving space to the steam unit by operating the water supply pump.

The control method may include one or more of the following optional features. The control method includes, after sensing the water level in the water supply tank and before moving residual water stored in the receiving space to the steam unit by operating the water supply pump, outputting a water replenishment alarm. The control method includes, after moving residual water stored in the receiving space to the steam unit by operating the water supply pump, outputting a water replenishment alarm. Moving residual water stored in the receiving space to the steam unit by operating the water supply pump includes operating the water supply pump for only a predetermined period of time.

Moving residual water stored in the receiving space to the steam unit by operating the water supply pump includes determining that all water in the water supply tank has moved to the steam unit; and based on determining that all water in the water supply tank has moved to the steam unit, stopping operation of the water supply pump. The control method includes sensing a water level in the steam unit; and based on sensing the water level in the steam unit and before sensing the water level in the water supply tank, determining whether the water level in the steam unit is below a second particular water level. Sensing the water level in the water supply includes sensing the water level in the water supply tank in response to determining that the level of water in the steam unit is below the second particular water level. The receiving space connects to the tank installation space. The lower rack further includes a water pocket that protrudes into the tank installation space and that is configured to support the water supply tank based on the water supply being mounted on the water pocket, and an inside of the water pocket further defines the receiving space.

The lower rack further includes a water barrier that protrudes upward from the water pocket, and the inside of the water barrier further defines the receiving space. The lower rack includes a lower base that is configured to mount, on the lower base, a drainage tank that is configured to store condensed water and the water supply tank; a lower back that is connected to the lower base and that, along with the tank module frame, partitions the cycle chamber from the tank installation space; and a lower partition wall that partitions a first installation part that is configured to allow the water supply tank to be mounted on the first installation part from a second installation part that is configured to allow the drainage tank to be mounted on the second installation part, where the first installation part further defines the receiving space.

According to another innovative aspect of the subject matter described in this application a control method of a clothes treatment apparatus including a cabinet that is partitioned into a treatment chamber that is configured to allow clothes to be hung in the treatment chamber, a cycle chamber that is configured to allow machinery to be installed in the cycle chamber, and a tank installation space that is configured to allow a removable tank to be installed in the tank installation space; a steam unit that is located in the cycle chamber and that is configured to supply steam to the treatment chamber; a water supply tank that is located in the tank installation space, that is connected to the steam unit, and that is configured to supply water to the steam unit; a water supply pump that is configured to supply water in the water supply tank to the steam unit; a lower rack that is located in the tank installation space and that is configured to separably couple to the water supply tank; and a receiving space that is defined by the lower rack, that is configured to connect to the steam unit, that is configured to supply water to the steam unit, and that is configured to store residual water discharged based on removing the water supply tank, where the control method includes sensing a water level in the steam unit; based on sensing the water level in the steam unit, determining whether the water level in the steam unit is below a first particular water level; sensing a water level in the water supply tank; based on sensing the water level in the water supply tank, determining that the water level in the water supply tank is below a second particular water level; and in response to determining that the water level in the water supply tank is below the second particular water level, moving all residual water stored in the receiving space to the steam unit and all water stored in the water supply tank to the steam unit by operating the water supply pump.

According to another innovative aspect of the subject matter described in this application a control method of a clothes treatment apparatus including a cabinet that is partitioned into a treatment chamber that is configured to receive clothes, a cycle chamber that is configured to house machinery, and a tank installation space that is configured to house a removable tank; a steam unit that is located in the cycle chamber and that is configured to supply steam to the treatment chamber; a water supply tank that is located in the tank installation space, that is connected to the steam unit, and that is configured to supply water to the steam unit; a water supply pump that is configured to supply water in the water supply tank to the steam unit; a lower rack that is located in the cabinet and that is configured to couple to the water supply tank; and a water pocket that is defined by the lower rack, that is configured to couple to the water pocket, that defines a receiving space that is configured to store residual water that is discharged during removal of the water supply tank, and that defines a flow channel that connects the receiving space and the steam unit, where the control method includes sensing a water level in the water supply tank; based on sensing the water level in the water supply tank, determining that the water level in the water supply tank is below a first particular water level; and in response to determining that the water level in the water supply tank is below the first particular water level, moving residual water stored in the receiving space to the steam unit by operating the water supply pump.

The control method may include one or more of the following optional features. The lower rack includes a lower base that is configured to mount, on the lower base, a drainage tank that is configured to store condensed water and the water supply tank; a lower back that is connected to the lower base and that, along with the tank module frame, partitions the cycle chamber from the tank installation space; and a lower partition wall that partitions a first installation part that is configured to allow the water supply tank to be mounted on the first installation part from a second installation part that is configured to allow the drainage tank to be mounted on the second installation part, where the first installation part further defines the receiving space.

The control method further includes, after sensing a water level in the water supply tank and before moving residual water stored in the receiving space to the steam unit by operating the water supply pump, outputting a water replenishment alarm. The control method further includes, after moving residual water stored in the receiving space to the steam unit by operating the water supply pump, outputting a water replenishment alarm. Moving residual water stored in the receiving space to the steam unit by operating the water supply pump includes determining that all water in the water supply tank has moved to the steam unit; and based on determining that all water in the water supply tank has moved to the steam unit, stopping operation of the water supply pump.

The control method further includes sensing a water level in the steam unit; and based on sensing the water level in the steam unit and before sensing the water level in the water supply tank, determining whether the water level in the steam unit is below a second particular water level. Sensing the water level in the water supply includes sensing the water level in the water supply tank in response to determining that the level of water in the steam unit is below the second particular water level. Moving residual water stored in the receiving space to the steam unit by operating the water supply pump includes operating the water supply pump for only a predetermined period of time.

It is an object of the subject matter disclosed in this application to provide a control method of a clothes treatment apparatus that is capable of removing residual water that leaks from a water supply tank.

DETAILED DESCRIPTION

Figure 1:
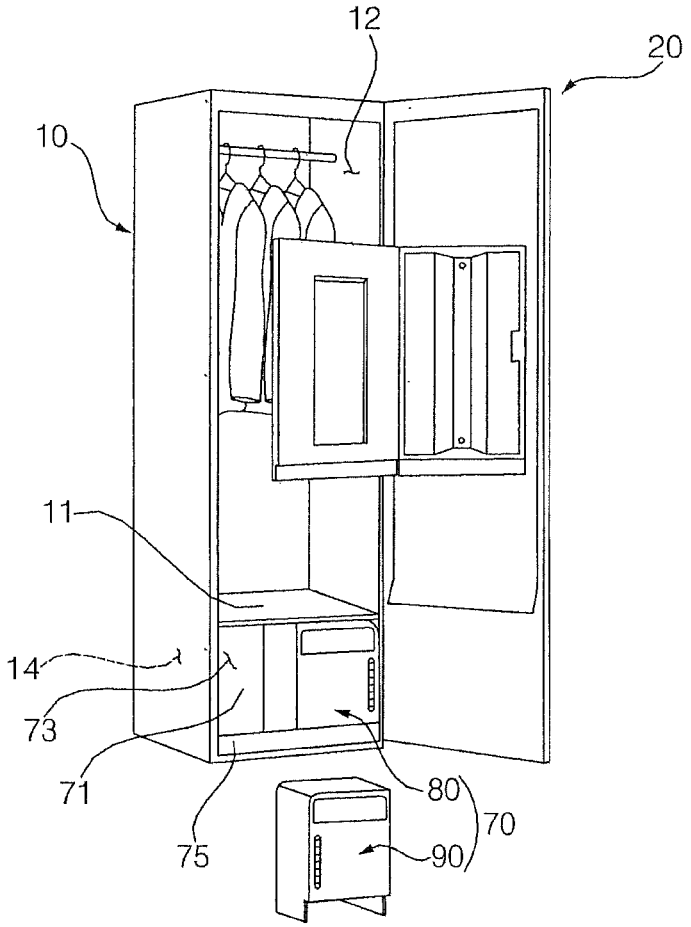
FIG. 1 is a perspective view of an example clothes treatment apparatus.
Figure 2:
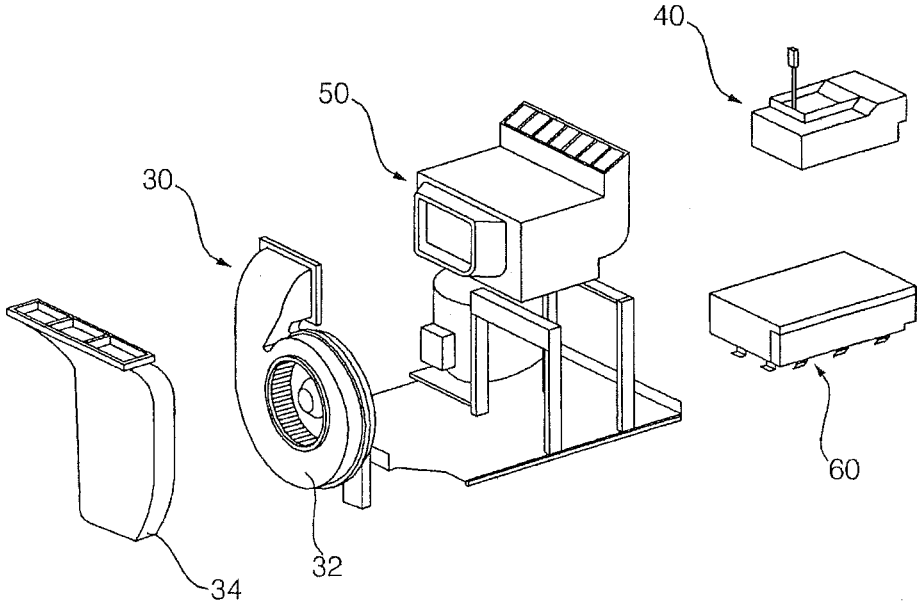
FIG. 2 is an exploded perspective view of an example cycle assembly.
Figure 3:
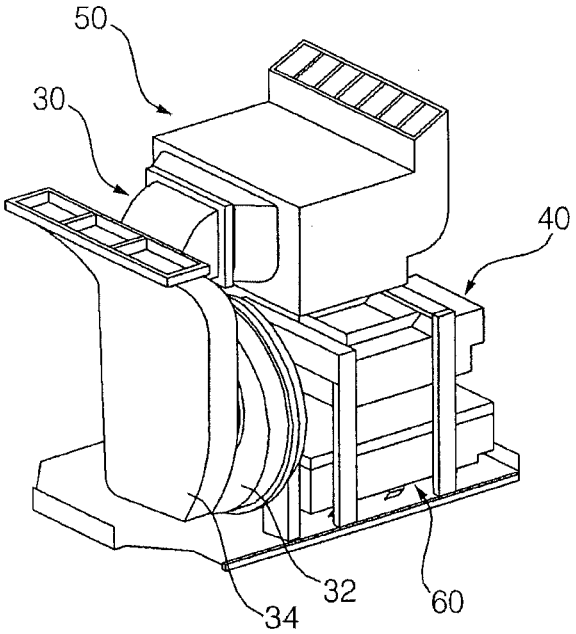
FIG. 3 is a perspective view of an example cycle assembly.
Figure 4:
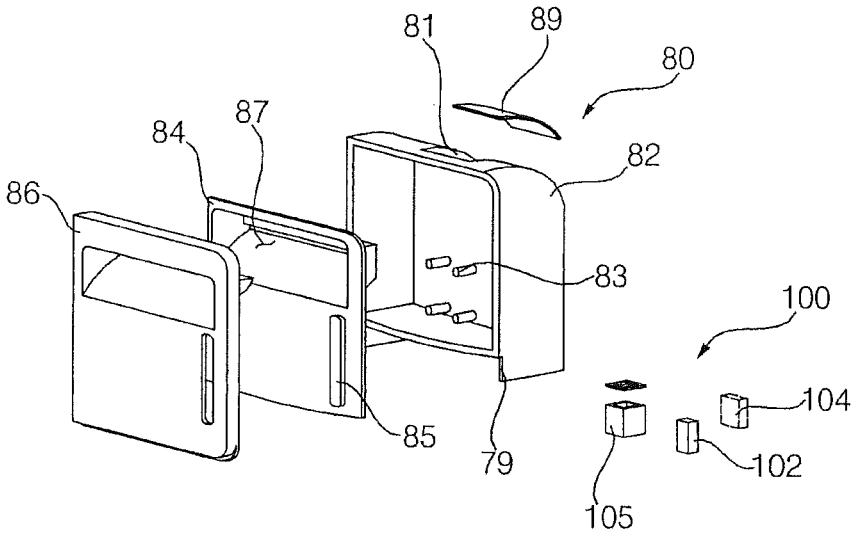
FIG. 4 is an exploded perspective view of an example water supply tank.
Figure 5:
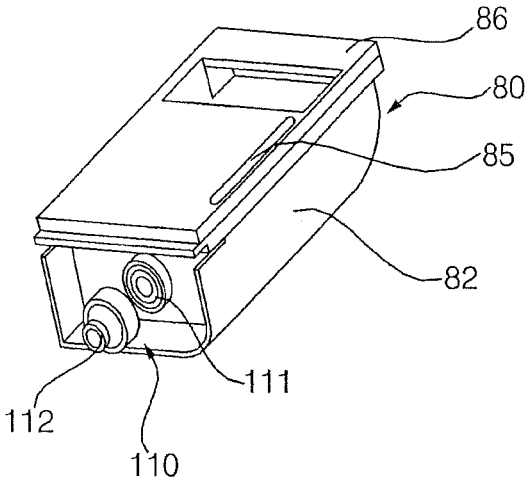
FIG. 5 is a partially exploded perspective view of an example water supply tank.
Figure 6:
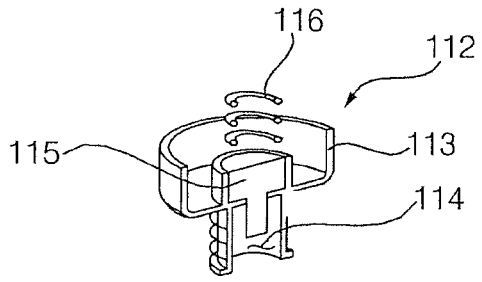
FIG. 6 is a sectional perspective view of an example check assembly.
Figure 7:
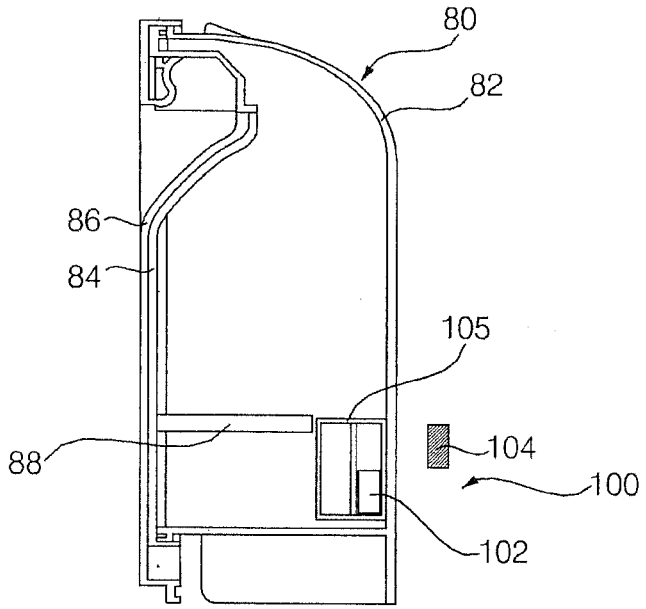
FIG. 7 is a side sectional view of an example water supply tank.
Figure 8:
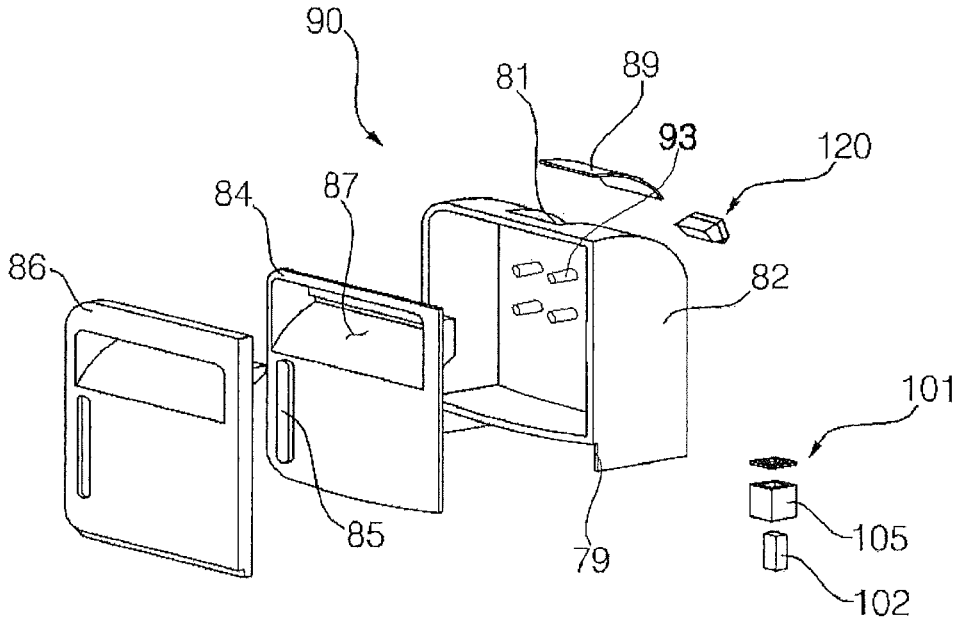
FIG. 8 is a perspective view of an example drainage tank.
Figure 9:
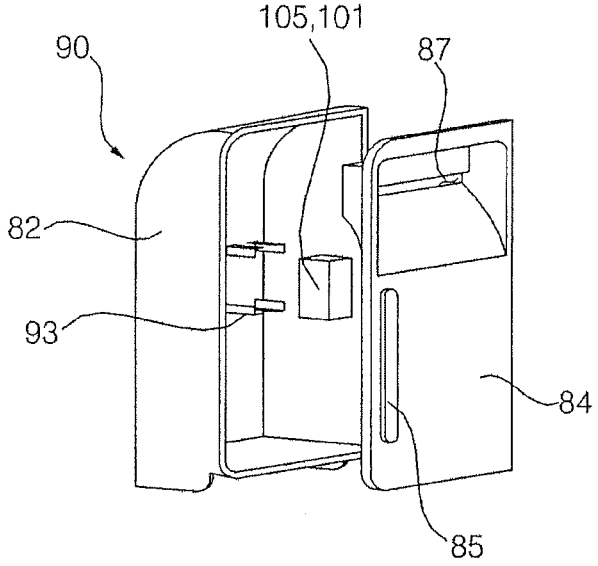
FIG. 9 is a partially exploded perspective view of an example drainage tank.
Figure 10:
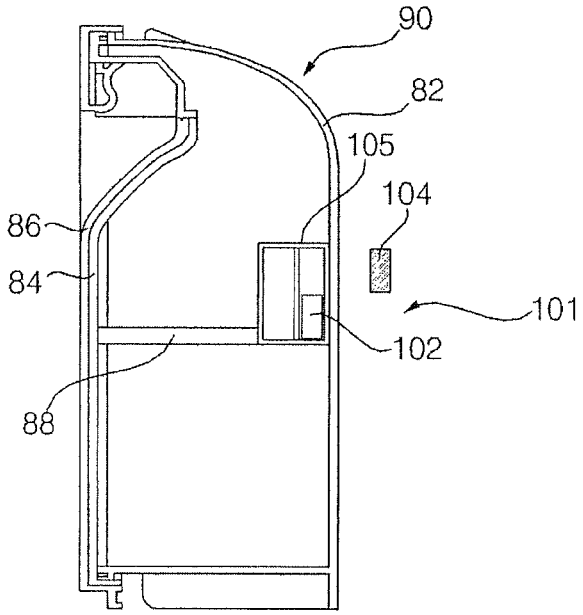
FIG. 10 is a side sectional view of an example drainage tank.

FIG. 1 illustrates an example clothes treatment apparatus. FIGS. 2 and 3 illustrate example cycle assemblies. FIGS. 4, 5, and 7 illustrate example water supply tanks. FIG. 6 illustrates an example check assembly. FIGS. 8, 9, and 10 illustrate example drainage tanks.

In some implementations, the clothes treatment apparatus includes a cabinet 10 and a door 20 configured to open and close the front of the cabinet 10.

The interior of the cabinet 10 is partitioned into upper and lower interior parts by a partition plate 11. A treatment chamber 12, in which clothes are hung, is defined in the interior of the cabinet 10 above the partition plate 11. A cycle chamber 14, in which machinery is installed, is defined in the interior of the cabinet 10 below the partition plate 11.

Clothes are hung in the treatment chamber 12. In the treatment chamber 12, wrinkles in the clothes are smoothed, or the clothes are deodorized, by the circulation of steam or air.

A blowing unit 30 for circulating air in the treatment chamber 12, a steam unit 40 for supplying steam into the treatment chamber 12, a heat pump unit 50 for conditioning air, e.g., cooling, heating, or dehumidification, in the treatment chamber 12, and a control unit 60 for controlling the respective units 30, 40, and 50 are installed in the cycle chamber 14.

In some implementations, an assembly of machinery, including the blowing unit 30, the steam unit 40, the heat pump unit 50, and the control unit 60, which are required to perform respective cycles of the clothes treatment apparatus, is defined as a cycle assembly.

The blowing unit 30 includes a blowing fan 32 and an inlet duct 34.

The inlet duct 34 is installed at the suction side of the blowing fan 32 to guide air in the treatment chamber 12 to the blowing fan 32.

The blowing fan 32 is rotated to blow air. The blowing fan 32 suctions air from the treatment chamber 12, and discharges the suctioned air to the heat pump unit 50.

When the steam unit 40 is powered on, heat is generated from the steam unit 40. The steam unit 40 converts water supplied from a water supply tank 80, which will be described hereinafter, into steam. The generated steam is discharged into the treatment chamber 12.

In some implementations, a flow channel is defined such that the steam flows into the treatment chamber 12 via the heat pump unit 50.

The heat pump unit 50 constitutes a heat pump cycle including a compressor, a condenser, an evaporator, and an expansion valve. Based on the operation mode of the heat pump unit 50, cooled air or heated air may be discharged into the treatment chamber 12.

In some implementations, the heat pump unit 50 may dehumidify air supplied from the blowing unit 30.

A tank module 70 for storing water is installed in front of the cycle chamber 14. The tank module 70 includes a water supply tank 80 for supplying water to the steam unit 40 and a drainage tank 90 for gathering and storing condensed water that is generated in the treatment chamber 12.

Water from the water supply tank 80 flows to the steam unit 40 via a water supply pump 45.

Water that is condensed in the treatment chamber 12, flows to the lower side of the treatment chamber 12 due to gravity, and is then pumped to the drainage tank 90 by a drainage pump 46. Water that is condensed in the heat pump unit 50 also flows to the drainage tank 90 via the drainage pump 46.

The water supply pump 45 or the drainage pump 46 is controlled by the control unit 60.

In some implementations, a tank module frame 71 is installed in front of the inlet duct 34.

A tank installation space 73 is defined between the tank module frame 71 and the door 20. The tank module frame 71 is coupled to the partition plate 11 to isolate the cycle chamber 14 from the outside.

A tank support bar 75, which interferes with at least one selected from between the water supply tank 80 and the drainage tank 90, is installed in front of the tank installation space 73.

The tank support bar 75 prevents the water supply tank or the drainage tank 90 from being unintentionally separated from the tank installation space 73. The tank support bar 75 supports the front of the water supply tank 80 and the front of the drainage tank 90.

When the door 20 is opened and closed, therefore, the water supply tank 80 and the drainage tank 90 are prevented from being separated from the tank installation space 73.

In some implementations, the lower end of the water supply tank 80 is placed on the upper end of the tank support bar 75, and the lower end of the drainage tank 90 is placed on the upper end of the tank support bar 75.

A tank support end 79, which interferes with the tank support bar 75, is formed on at least one selected from between the water supply tank 80 and the drainage tank 90.

The tank support end 79 is concavely recessed.

The front of the tank support bar 75 and the front of the water supply tank 80 may form a continuous surface due to the tank support end 79. In addition, the front of the tank support bar 75 and the front of the drainage tank 90 may form a continuous surface due to the tank support end 79.

The water supply tank 80 and the drainage tank 90 are disposed in the tank installation space 73 such that the water supply tank 80 and the drainage tank 90 are arranged parallel to each other in rightward and leftward directions.

When the door 20 is opened, the water supply tank 80 and the drainage tank 90 are exposed to a user.

The water supply tank 80 and the drainage tank 90 may be withdrawn by the user.

The water supply tank 80 and the drainage tank 90 may be separated from the tank module frame 71. The water supply tank 80 and the drainage tank 90 may be separably mounted in the tank installation space 73.

The water supply tank 80 is connected to the steam unit 40 to supply water to the steam unit 40. The drainage tank 90 is connected to the treatment chamber 12 to store water discharged from the treatment chamber 12 or the heat pump unit 50.

The water supply tank 80 includes a tank body 82, which is open at the front thereof, a tank cover 84 coupled to the front of the tank body 82, a decorative cover 86 coupled to the tank cover 84, a water supply check valve 110 installed in the tank body 82 for opening and closing a flow channel connected with the steam unit 40, and a water supply level sensor 100 for sensing the level of water stored in the tank body 82.

The front of the tank body 82 is open. The water supply level sensor 100 is disposed in the tank body 82.

The upper end of the tank body 82 is round at the rear side thereof.

When the tank body 82 is separated, interference between the tank body 82 and the partition plate 11 is minimized.

The user may pull and withdraw the water tank 80, which is disposed at the lower side of the clothes treatment apparatus, due to the round shape of the tank body 82.

In some implementations, the water supply level sensor 100 includes a float 102 installed in the tank body 82 such that the float 102 can move upward and downward based on the level of water stored in the tank body 82, a float cabinet 105 installed in the tank body 82 in a state in which the float 102 is disposed in the float cabinet 105, and a sensor 104 installed at the tank module frame 71 to sense the float 102.

The float 102 has a magnet. The sensor 104 senses the magnetic force of the magnet.

The sensor 104 may be installed at the front or rear of the tank module frame 71.

The sensor 104 may be installed through the tank module frame 71.

Consequently, the sensor 104 may be located in any one selected from among the cycle chamber 14, the tank installation space 73, and the tank module frame 71.

The float 102, which is installed in the water supply tank 80, is flush with the sensor 104. When the level of water stored in the water supply tank 80 is lowered, the float 102 moves lower than the sensor 104. When the sensor 104 fails to sense the float 102, therefore, the control unit 60 outputs a water deficiency signal. Even when the water deficiency signal is output, it is possible to supply a sufficient amount of steam during a cycle that is currently being performed.

Since the sensor 104 constantly senses the float 102, the control unit 60 may determine whether the water supply tank 80 is mounted.

For example, when the water supply tank 80 is not mounted, or when water is deficient, the control unit 60 outputs a water deficiency signal.

When the user manipulates the clothes treatment apparatus in a state in which the water deficiency signal is output, therefore, the control unit 60 performs control such that the clothes treatment apparatus is not operated and outputs a water deficiency signal. At this time, the user may check the water supply tank 80.

A float installation part 83, at which the float 102 is installed, is formed at the inside of the tank body 82. The float cabinet 105 is installed at the float installation part 83. The float 102 may move upward and downward along the float cabinet 105 by buoyancy.

In some implementations, the float 102 is installed at the minimum level of water stored in the water supply tank 80, at which it is possible to supply an amount of steam corresponding to one cycle. Even when the sensor 104 fails to sense the float 102, and therefore the control unit 60 outputs a water deficiency signal, it is possible to supply an amount of steam corresponding to at least one cycle.

That is, even when a water deficiency signal is sensed during the supply of steam, it is possible to supply a sufficient amount of steam until a cycle that is currently being performed is completed.

The float cabinet 105, in which the float 102 is mounted, is manufactured by insert injection molding at the time of die slide injection (DSI) of the tank cover 84 and the tank body 82.

Die slide injection (DSI) is for blow molding or molding of thin products. DSI conveys various advantages in that no post-processing, such as adhesion or assembly, is necessary after injection molding, it is possible to adjust the thickness of a wall more easily than when blow molding or gas molding, it is possible to provide an excellent surface shape or high dimensional accuracy, and it is possible to perform DSI instead of double injection or blow molding.

The tank body 82 and the tank cover 84 are manufactured by insert injection molding using DSI. During the manufacture of the tank body 82 and the tank cover 84, the float cabinet 105 is installed in the tank body 82 and the tank cover 84 by insert injection molding. During the manufacture of the tank body 82 and the tank cover 84, the edge of the tank cover 84 is integrally coupled to the edge of the tank body 82.

The tank cover 84 has a window 85, through which the user may check the level of water in the tank body 82. In addition, a grip 87, into which the user may insert his/her hand in order to hold the tank cover 84, is concavely formed at the tank cover 84.

The grip 87 is formed at the tank cover 84 such that the grip 87 is concave from the front to the rear thereof.

A sensor fixing part 88 is formed at the inside of the tank cover 84. The sensor fixing part 88 protrudes from the inside of the tank cover 84. When the tank cover 84 and the tank body 82 are coupled to each other, the sensor fixing part 88 comes into tight contact with the float cabinet 105.

Since the sensor fixing part 88 tightly contacts the float cabinet 105, the float cabinet 105 is prevented from being separated from the float installation part 83.

The sensor fixing part 88 may be integrally formed with the tank cover 84.

The decorative cover 86 is formed to have a shape that is capable of covering the front of the tank cover 84. In addition, the decorative cover 86 is formed to have a shape corresponding to the shape of the tank cover 84.

A water hole 82 is formed at the upper side of the tank body 92. In addition, a water hole cover 89 for opening and closing the water hole 82 is disposed at the upper side of the tank body 92.

The water hole cover 89 is made of a flexible material exhibiting high elasticity. One end of the water hole cover 89 is fixed to the tank body 82, and the other end of the water hole cover 89 may be bent in order to open and close the water hole 82.

The water supply check valve 110 includes a check valve hole 111 formed at the lower side of the tank body 82 and a check assembly 112 coupled to the check valve hole 111 for regulating the water in the tank body 82.

The check assembly 112 includes a check housing 113 coupled into the check valve hole 111, the check housing 113 having a check flow channel 114, through which water flows into the check housing 113, a valve 115 disposed in the check housing 113 for opening and closing the check flow channel 114, and a check elastic member 116 disposed between the valve 115 and the tank body 82 for applying elastic force to the valve 115.

The small-diameter side of the valve 115 protrudes downward. When the valve 115 is placed on the tank module frame 71, the valve 115 may be pushed by the tank module frame 71, and may thus move upward. At this time, the check flow channel 114 is opened as the result of the movement of the valve 115. When the water supply tank 80 is separated from the tank module frame 71, the check flow channel 114 is closed by the elastic force of the check elastic member 116.

The drainage tank 90 is identical in function to the water supply tank 80. The drainage tank 90 is disposed alongside the water supply tank 80.

In the drainage tank 90, a drainage check valve 120 is installed at the rear side thereof, not at the lower side thereof, unlike the water supply tank 80.

The water supply tank 80 receives water through the water hole 81, and discharges water through the water supply check valve 110. The drainage tank 90 may receive condensed water through the drainage check valve 120, and may discharge condensed water through the water hole 81.

That is, the drainage check valve 120 of the drainage tank 90 may be disposed in a channel for receiving condensed water, not for discharging condensed water.

In some implementations, condensed water may fall into the drainage tank 90 through the water hole 81. In addition, condensed water may be automatically discharged through the drainage check valve 120.

Water that is condensed in the treatment chamber 12 and water that is condensed in the heat pump unit 50 are stored in the drainage tank 90.

A float installation part 93, at which the float cabinet 105 is installed, is formed in the drainage tank 90.

The float installation part 93 may be located at a height in the drainage tank 90 at which overflow does not occur even when an amount of condensed water that is generated during one cycle is stored therein.

That is, the float installation part 93 is located at a height in the drainage tank 90 at which overflow does not occur even when an amount of condensed water that is generated during one cycle is stored in the drainage tank 90.

When a drainage level sensor 101 of the drainage tank senses a signal during the operation of the clothes treatment apparatus, therefore, the water in the drainage tank 90 does not overflow due to the condensed water that is additionally stored in the drainage tank 90.

The drainage level sensor 101 of the drainage tank 90 is located higher than the water supply level sensor 100 in the water supply tank 80.

The drainage level sensor 101 of the drainage tank 90 is identical in construction to the water supply level sensor 100 of the water supply tank 80. However, the drainage level sensor 101 of the drainage tank 90 is operated differently from the water supply level sensor 100 of the water supply tank 80.

For example, the sensor 104 of the drainage tank 90 does not sense the float 102 in a normal state. When the level of condensed water rises, the sensor 104 of the drainage tank 90 senses the float 102, which has been raised by buoyancy.

When the sensor 104 of the drainage tank 90 senses the float 102, the control unit 60 outputs a water drainage signal. When the water drainage signal is output, however, the overflow of condensed water does not occur during a cycle that is currently being performed.

Meanwhile, a lower rack 130, on which the water supply tank 80 and the drainage tank 90 are mounted, is disposed at the lower side of the tank installation space 73. The lower rack 130 defines the tank installation space 73 together with the tank module frame 71.

The lower rack 130 is an element that defines the lower part of the cabinet 10. The lower rack 130 is assembled with the tank module frame 71 to support the water supply tank 80 and the drainage tank 90.

Figure 11:
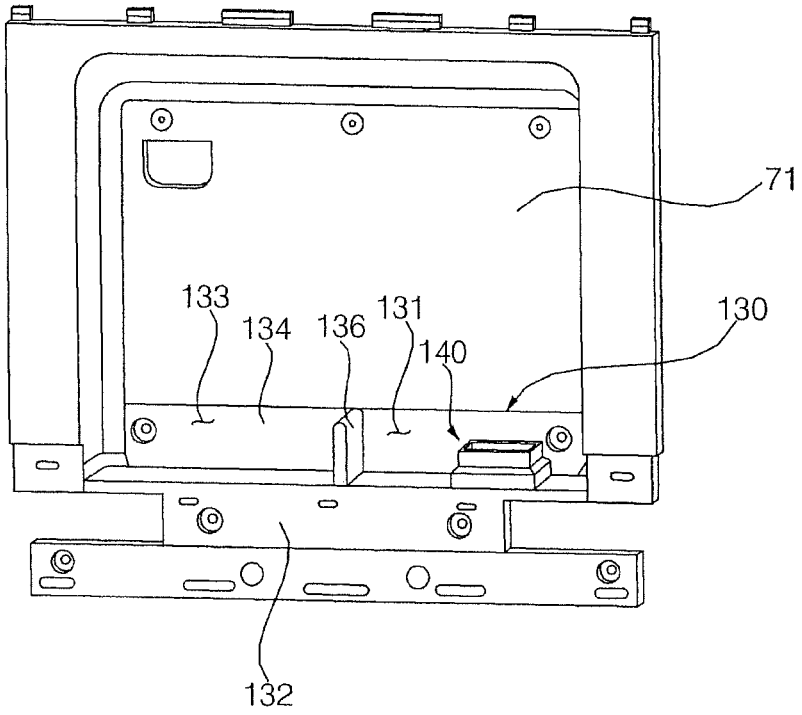
FIG. 11 is a perspective view of an example lower rack.
Figure 12:
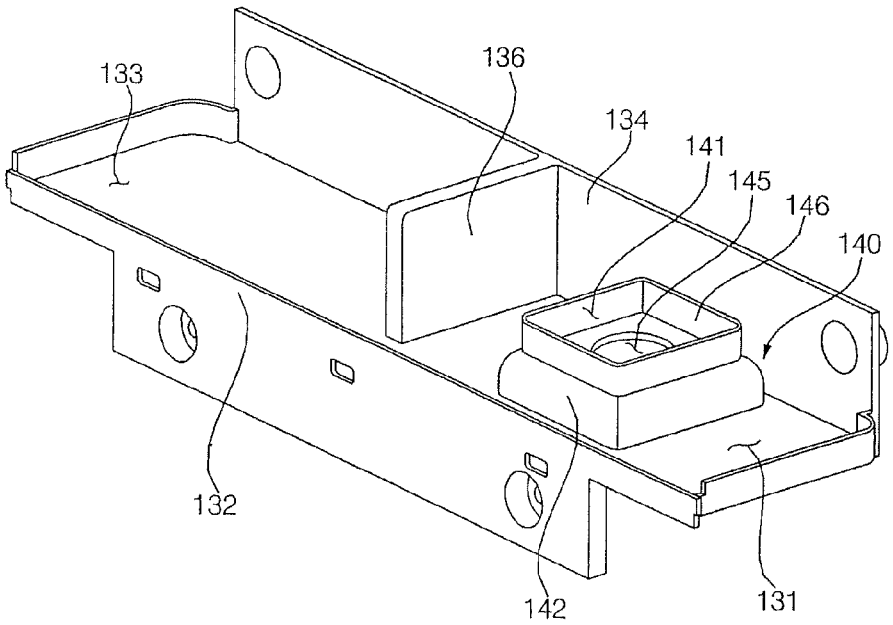
FIG. 12 is a perspective view of an example lower rack.
Figure 13:
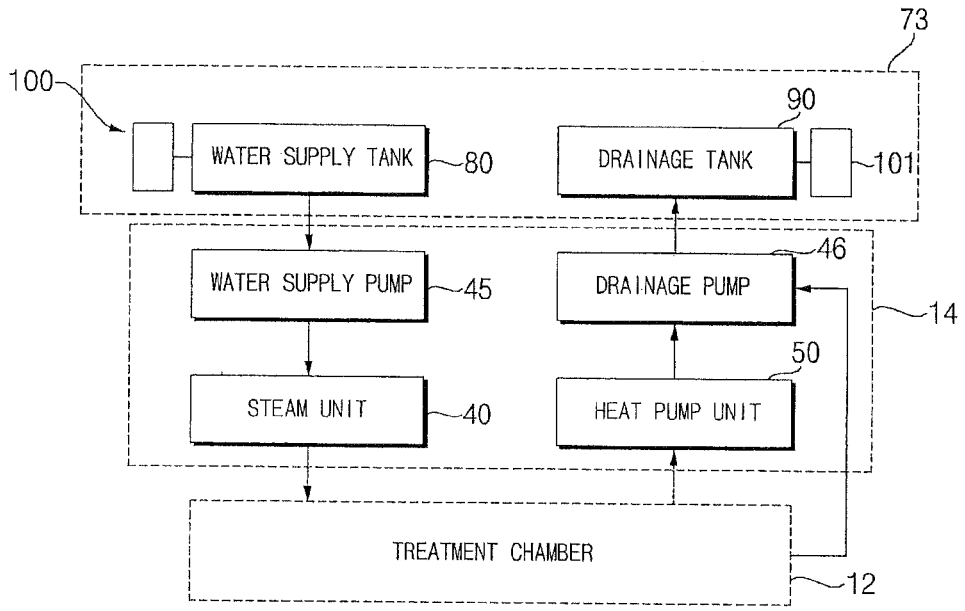
FIG. 13 is a block diagram of an example clothes treatment apparatus.

FIGS. 11 and 12 illustrate example lower racks. FIG. 13 illustrates an example clothes treatment apparatus. The lower rack 130 is an element that constitutes the cabinet 10.

In some implementations, the lower rack 130 is provided with a flow channel, which connects the water supply tank 80 and the steam unit 40 to each other. In some implementations, the tank module frame 71 is provided with a flow channel, which connects the drainage tank 90 and the heat pump unit 50 to each other.

The lower rack 130 includes a lower base 132, on which the water supply tank 80 and the drainage tank 90 are mounted, and a lower back 134 connected to the lower base 132, the lower back 134 being assembled with the tank module frame 71.

In some implementations, a lower partition wall 136 is further provided to partition the lower base 132 into left and right base parts. One part of the lower base 132 partitioned by the lower partition wall 136 is defined as a first installation part 131, and the other part of the lower base 132 partitioned by the lower partition wall 136 is defined as a second installation part 133.

In some implementations, the water supply tank 80 is mounted on the first installation part 131, and the drainage tank 90 is mounted on the second installation part 133. In some implementations, the lower partition wall 136 may not be provided.

The lower back 134 forms a continuous surface with the tank module frame 71.

The lower back 134 separates the cycle chamber 14 and the tank installation space 73 from each other together with the tank module frame 71.

The lower back 134 is disposed perpendicular to the lower partition wall 136.

The lower partition wall 136 partitions an installation space for the water supply tank 80 and an installation space for the drainage tank 90 from each other. In addition, the lower partition wall 136 prevents the water supply tank 80 or the drainage tank 90 from interfering with the drainage tank 90 or the water supply tank 80 when the water supply tank 80 or the drainage tank 90 is separated.

As will be described hereinafter, when the water supply tank 80 is shaken or lifted, a small amount of water from the water supply check valve 110 may be discharged into a receiving space 141. When the water from the water supply check valve 110 is repeatedly discharged into the receiving space 141, the water may overflow the receiving space 141. As a result, the water may overflow a water pocket 140. The lower partition wall 136 functions to prevent interference between the water supply tank 80 and the drainage tank 90, which are adjacent to each other.

In some implementations, the water pocket 140 is disposed on the first installation part 131.

The water supply tank 80 is coupled to the water pocket 140.

The water supply check valve 110 of the water supply tank 80 is inserted into the water pocket 140.

When the water supply check valve 110 is inserted into the water pocket 140, a flow channel for connecting the water supply tank 80 and the steam unit 40 to each other is defined.

The water pocket 140 stores a predetermined amount of water discharged from the water supply check valve 110.

The water pocket 140 includes a pocket housing 142 formed at the lower base 132 such that the pocket housing 142 protrudes upward from the lower base 132, a water hole 145 formed at the pocket housing 142, the water hole 145 being provided with a flow channel communicating with the steam unit 40, and a water barrier 146 formed at the pocket housing 142, the water barrier 146 defining the receiving space 141 inside the pocket housing 142.

The water hole 145 is formed inside the pocket housing 142. The pocket housing 142 is coupled with the water supply check valve 110 of the water supply tank 80. The pocket housing 142 supports the water supply tank 80.

In some implementations, the water barrier 146 protrudes upward from the pocket housing 142. In some implementations, the pocket housing 142 may be recessed to define the receiving space 141.

A small amount of water may be stored in the receiving space 141. The water hole 145 is located inside the receiving space 141. The water stored in the receiving space 141 may flow to the steam unit 40 via the water hole 145.

The receiving space 141 is formed so as to be open toward the tank installation space 73.

The water supply tank 80 may be mounted on the water barrier 146 such that the water supply tank 80 is supported by the water barrier 146.

When the water supply tank 80 is mounted on the water pocket 140, the water supply check valve 110 remains open.

As a result, when the water supply tank 80 is separated from the lower rack 130, a small amount of water may be discharged through the water supply check valve 110. The discharged water is stored in the receiving space 141. That is, when the water supply tank 80 is separated, a small amount of water discharged while the water supply check valve 110 is closed may be stored in the receiving space 141.

When the water supply tank 80 is repeatedly separated, water discharged through the water supply check valve 110 may overflow the water pocket 140.

In some implementations, a control method is capable of moving water stored in the receiving space 141 to the steam unit 40. As a result, it is possible to prevent water in the receiving space 141 from overflowing the receiving space 141 when the water supply tank 80 is repeatedly separated.

Water stored in the receiving space 141 is referred to as residual water.

Figure 14:
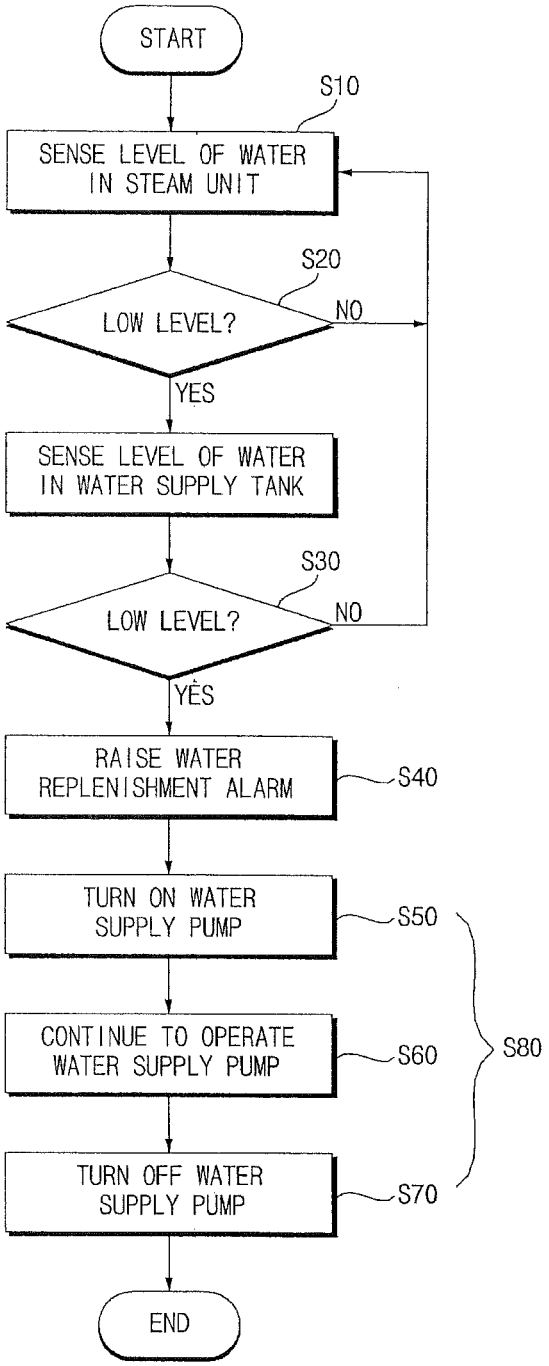
FIG. 14 is a flowchart showing an example control method of an example clothes treatment apparatus.

FIG. 14 illustrates an example control method of an example clothes treatment apparatus.

In some implementations, a control method of the clothes treatment apparatus includes a step (S10) of sensing the level of water in the steam unit 40, a step (S20) of determining whether the level of water in the steam unit 40 is low, a step (S30) of, upon determining that the level of water in the steam unit 40 is low (S35), sensing the level of water in the water supply tank 80, a step (S40) of, when the level of water in the water supply tank 80 is low, raising a water replenishment alarm, a step (S50) of operating the water supply pump 45 such that the water from the water supply tank 80 flows to the steam unit 40 to remove water stored in the receiving space 141, a step (S60) of maintaining the operation of the water supply pump 45 for a predetermined period of time, and a step (S70) of stopping the operation of the water supply pump 45 after the predetermined period of time.

The low level means a reference level or less.

In some implementations, the low level of the water in the water supply tank 80 means a state in which the sensor 140 cannot sense the float 120.

The control method is performed in order to prevent water stored in the receiving space 141 from overflowing the receiving space 141 during separation of the water supply tank 80.

In some implementations in which insufficient water is stored in the water supply tank 80, the user may separate the water supply tank 80 from the lower rack 130, and may replenish the water supply tank 80 with water. Subsequently, the user may couple the water supply tank 80, which has been replenished with water, to the lower rack 130.

At this time, if residual water is stored in the receiving space 141, the water overflows the receiving space 141 when the water supply tank 80 is coupled to the lower rack 130.

In some implementations, the control method is performed in order to move water stored in the receiving space 141 to the steam unit 40 such that residual water stored in the receiving space 141 is prevented from overflowing from the receiving space 141.

Steps S10 to S40 are performed in order to notify the user that it may be time to replenish water.

At steps S10 and S20, the level of water stored in the steam unit 40 is sensed and, it is determined whether the level of water stored in the steam unit 40 is low. Upon determining that the level of water stored in the steam unit 40 is low, the level of water in the water supply tank 80 is sensed at step S30.

When the level of water stored in the water supply tank 80 sensed at step S30 is low, a water replenishment alarm is raised in order to notify the user that it may be time to replenish water.

The water replenishment alarm may be raised through a display unit or a speaker unit of the clothes treatment apparatus.

Upon determining at step S35 that the level of water stored in the water supply tank 80 is low, the control unit 60 controls the water supply pump 45 to be operated such that the water from the water supply tank 80 flows to the steam unit 40.

In some implementations, the control unit 60 controls the water supply pump 45 to be operated such that all of the water stored in the water supply tank 80 moves to the steam unit 40. As all of the water stored in the water supply tank 80 moves to the steam unit 40, it is possible to remove all of the residual water from the receiving space 141.

The residual water stored in the receiving space 141 moves to the steam unit 40, and is stored in the steam unit 40, by the operation of the water supply pump 45.

As the residual water is removed from the receiving space 141, it is possible to prevent the residual water from overflowing the receiving space 141 even though a small amount of water is discharged when the user separates the water supply tank 80 from the lower rack 130 to replenish water.

In some implementations, after the water supply pump 45 is operated, the operation of the water supply pump 45 is continued for 10 seconds at step S60, and the operation of the water supply pump 45 is stopped at step S70.

The above-defined period of time, e.g. 10 seconds, is a period of time that may be necessary to move all the water stored in the water supply tank 80 to the steam unit 40. The period of time may be set differently based on the size of the water supply tank 80.

In some implementations in which all of the water is removed from the water supply tank 80, as described above, it is possible to store a larger amount of water in the water supply tank 80 when the user replenishes the water supply tank 80 with water.

In other words, in a case in which all of the water is removed from the receiving space 141 and the water supply tank 80 during a residual water removal process, and then the user replenishes the water supply tank 80 with water, it is possible to maximize the amount of water that is stored in the clothes treatment apparatus. As a result, it is possible to reduce the frequency with which the user replenishes the water supply tank 80 with water.

Steps S50 to S70 are defined as a residual water removal step (S80).

In some implementations, the water supply pump 45 may be operated for a short period of time in order to remove only residual water stored in the receiving space 141.

In some implementations, when the low level of the water in the water supply tank 80 is sensed, steps S50 to S70 may be performed in order to remove the residual water from the receiving space 141 without raising a water replenishment alarm.

Figure 15:
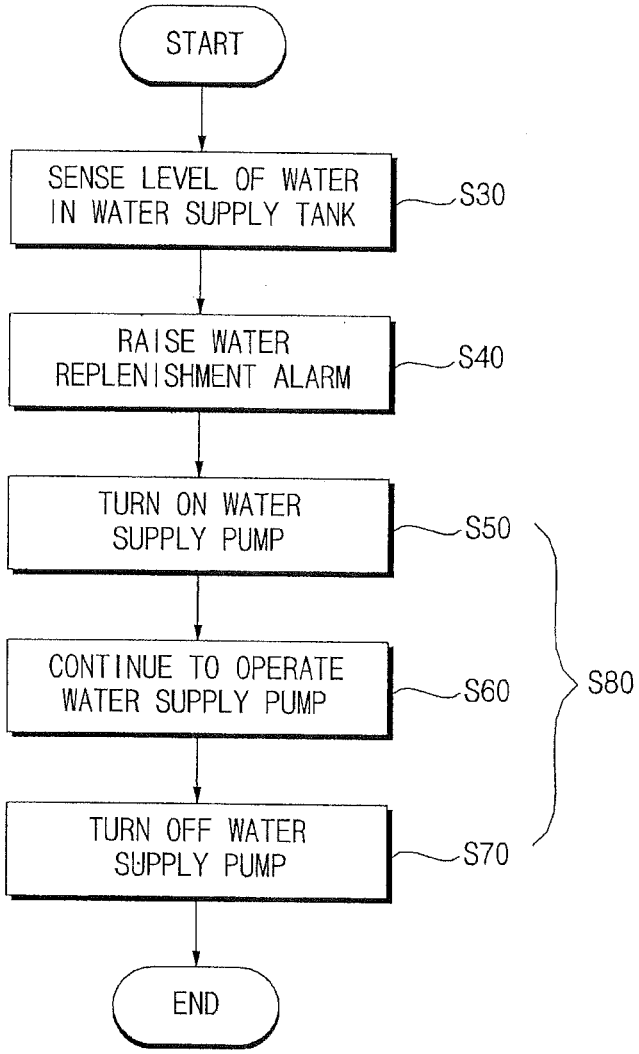
FIG. 15 is a flowchart showing an example control method of an example clothes treatment apparatus.

FIG. 15 illustrates an example control method of an example clothes treatment apparatus In some implementations, determination as to whether the level of water in the steam unit 40 is low is omitted, and, upon determining that the level of water in the water supply tank 80 is low, the water supply motor 45 is immediately operated in order to remove residual water from the receiving space 141.

Since the water supply motor 45 may be operated only when it is necessary to replenish the steam unit 40 with water, the steam unit 40 has a space that is capable of receiving water equivalent to the low level of water in the water supply tank 80.

In some implementations, upon determining that the level of water in the water supply tank 80 is low, the water supply motor 45 is operated in order to move residual water from the receiving space 141 to the steam unit 40.

The water supply motor 45 may be sufficiently operated for a predetermined period of time in order to move all of the water from the water supply tank 80 to the steam unit 40.

In addition, the water supply motor 45 may be operated after a water replenishment alarm is raised. Alternatively, the water supply motor 45 may be operated irrespective of whether a water replenishment alarm is raised.

For example, in some implementations, upon determining that the level of water in the water supply tank 80 is low, all of the residual water or the water remaining in the water supply tank 80 may be moved to the steam unit 40, and then a water replenishment alarm may be raised.

As a result, it is possible to prevent the user from separating the water supply tank during the movement of the water from the water supply tank 80 to the steam unit 40.

As is apparent from the above description, the control method of the clothes treatment apparatus has the following effects.

First, residual water discharged and stored in the receiving space during separation of the water supply tank is moved to the steam unit. Consequently, it is possible to prevent the residual water from overflowing the receiving space when the water supply tank is mounted.

Second, when it is determined that the level of water in the water supply tank is low, all of the residual water stored in the receiving space and all of the water remaining in the water supply tank are moved to the steam unit. Consequently, it is possible to securely remove the residual water from the receiving space.

Third, when it is determined that the level of water in the water supply tank is low, all of the residual water stored in the receiving space and all of the water remaining in the water supply tank are moved to the steam unit. Consequently, it is possible to maximize the amount of water stored in the clothes treatment apparatus when the user replenishes the water supply tank with water.

Fourth, when residual water is removed from the receiving space, the maximum amount of water that is usable is stored in the steam unit. Consequently, it is possible to reduce the number of times that water is replenished.

Fifth, the water supply tank installation space and the drainage tank installation space are partitioned by the lower partition wall. Consequently, it is possible to minimize the discharge of residual water.

What is claimed is:

1. A control method of a clothes treatment apparatus comprising:

a cabinet that is partitioned into:

a treatment chamber that is configured to receive clothes, a cycle chamber that is configured to house machinery, and a tank installation space that is configured to house a removable tank;

a steam unit that is located in the cycle chamber and that is configured to supply steam to the treatment chamber;

a water supply tank that is located in the tank installation space, that is connected to the steam unit, and that is configured to supply water to the steam unit;

a water supply pump that is configured to supply water in the water supply tank to the steam unit;

a lower rack that is located in the tank installation space and that is configured to couple to the water supply tank; and a receiving space that is defined by the lower rack, that is configured to connect to the steam unit, that is configured to supply water to the steam unit, and that is configured to store residual water discharged based on removing the water supply tank, wherein the control method comprises:

sensing a water level in the water supply tank;

based on sensing the water level in the water supply tank, determining that the water level in the water supply tank is below a first particular water level;

in response to determining that the water level in the water supply tank is below the first particular water level, moving residual water stored in the receiving space to the steam unit by operating the water supply pump;

determining that all water in the water supply tank has moved to the steam unit; and based on determining that all water in the water supply tank has moved to the steam unit, stopping operating of the water supply pump.

2. The control method according to claim 1, further comprising:

after sensing the water level in the water supply tank and before moving residual water stored in the receiving space to the steam unit by operating the water supply pump, outputting a water replenishment alarm.

3. The control method according to claim 1, further comprising:

after moving residual water stored in the receiving space to the steam unit by operating the water supply pump, outputting a water replenishment alarm.

4. The control method according to claim 1, wherein moving residual water stored in the receiving space to the steam unit by operating the water supply pump comprises operating the water supply pump for only a predetermined period of time.

5. The control method according to claim 1, further comprising:

sensing a water level in the steam unit; and based on sensing the water level in the steam unit and before sensing the water level in the water supply tank, determining whether the water level in the steam unit is below a second particular water level.

6. The control method according to claim 5, wherein sensing the water level in the water supply tank comprises sensing the water level in the water supply tank in response to determining that the level of water in the steam unit is below the second particular water level.

7. The control method according to claim 1, wherein the receiving space connects to the tank installation space.

8. A control method of a clothes treatment apparatus comprising:

a cabinet that is partitioned into:

a treatment chamber that is configured to receive clothes, a cycle chamber that is configured to house machinery, and a tank installation space that is configured to house a removable tank;

a steam unit that is located in the cycle chamber and that is configured to supply steam to the treatment chamber;

a water supply tank that is located in the tank installation space, that is connected to the steam unit, and that is configured to supply water to the steam unit;

a water supply pump that is configured to supply water in the water supply tank to the steam unit;

a lower rack (i) that is located in the tank installation space, (ii) that is configured to couple to the water supply tank, and (iii) that comprises a water pocket (i) that protrudes into the tank installation space and (ii) that is configured to support the water supply tank based on the water supply being mounted on the water pocket; and a receiving space that is defined by the lower rack and by an inside of the water pocket, that is configured to connect to the steam unit, that is configured to supply water to the steam unit, and that is configured to store residual water discharged based on removing the water supply tank, wherein the control method comprises:

sensing a water level in the water supply tank;

based on sensing the water level in the water supply tank, determining that the water level in the water supply tank is below a first particular water level; and in response to determining that the water level in the water supply tank is below the first particular water level, moving residual water stored in the receiving space to the steam unit by operating the water supply pump.

9. The control method according to claim 8, wherein:

the lower rack further comprises a water barrier that protrudes upward from the water pocket, and the inside of the water barrier further defines the receiving space.

10. The control method according to claim 1, wherein the lower rack comprises:

a lower base that is configured to mount, on the lower base, a drainage tank that is configured to store condensed water and the water supply tank;

a lower back that is connected to the lower base and that, along with a tank module frame, partitions the cycle chamber from the tank installation space; and a lower partition wall that partitions a first installation part that is configured to allow the water supply tank to be mounted on the first installation part from a second installation part that is configured to allow the drainage tank to be mounted on the second installation part, wherein the first installation part further defines the receiving space.

* * * * *